US010010161B2

(12) United States Patent
Castellanos-Ibanez et al.

(10) Patent No.: US 10,010,161 B2
(45) Date of Patent: Jul. 3, 2018

(54) PERSONAL HYDRATION DEVICE

(71) Applicant: TLG Technologies, LLC, St. Petersburg, FL (US)

(72) Inventors: Yanko Castellanos-Ibanez, St. Petersburg, FL (US); Cory Vibbert, Long Beach, CA (US); John Camp, North Hollywood, CA (US)

(73) Assignee: TLG TECHNOLOGIES, LLC, St. Petersburg, FL (US)

( * ) Notice: Subject to any disclaimer, the term of this patent is extended or adjusted under 35 U.S.C. 154(b) by 81 days.

(21) Appl. No.: 15/138,401

(22) Filed: Apr. 26, 2016

(65) Prior Publication Data

US 2017/0303670 A1 Oct. 26, 2017

(51) Int. Cl.

| | |
|---|---|
| ***A45F 5/00*** | (2006.01) |
| ***A45F 3/00*** | (2006.01) |
| ***B67D 7/84*** | (2010.01) |
| ***A45F 3/20*** | (2006.01) |

(52) U.S. Cl.
CPC ..... *A45F 3/20* (2013.01)

(58) Field of Classification Search
CPC ..... A45F 3/20; A45F 3/06; A45F 2003/006; A45F 2003/166
USPC ..... 224/148.2, 661, 624; 222/175
See application file for complete search history.

(56) References Cited

U.S. PATENT DOCUMENTS 4,988,097 A 1/1991 Smith
5,377,912 A * 1/1995 Webb ..... A62C 3/07 169/52
5,445,303 A * 8/1995 Cawile, Jr. ..... A45F 5/00 224/222
5,538,164 A * 7/1996 Rivas ..... F41H 9/10 222/153.04
5,566,869 A 10/1996 Katz
5,820,825 A 10/1998 Weinzierl
6,409,048 B1 6/2002 Belzeski
7,311,231 B2 12/2007 Noell
8,020,730 B2 9/2011 Liang
8,083,105 B2 * 12/2011 Reichert ..... A45F 3/20 220/703
8,152,011 B2 4/2012 Willows
8,167,177 B1 5/2012 Galgano
(Continued)

FOREIGN PATENT DOCUMENTS

WO 2008055296 5/2008
WO 2013029343 3/2013

*Primary Examiner* — Derek Battisti
(74) *Attorney, Agent, or Firm* — Maxey-Fisher, PLLC; Stephen Lewellyn

(57) ABSTRACT

A hydration device has a flexible bladder constructed to have a plurality of expandable liquid receiving chambers that extend laterally across the width of the bladder and are spaced from one another along the length of the bladder. Liquid conveying tubes are in fluidic communication with liquid chambers. A coupling is fluidically connected to the tubes and includes a valve that operates to seal the coupling from the tubes. A drinking tube has a first end that is fluidically connected to the coupling thereby establishing a fluidic connection between the drinking tube and the tubes. A bite valve is connected to a second end of the drinking tube and is operable to allow a user to drink liquid from the chambers. The drinking tube may be secured to a user's wrist by a wrist strap.

17 Claims, 8 Drawing Sheets

(56) References Cited

U.S. PATENT DOCUMENTS

| | | | | |
|---|---|---|---|---|
| 8,387,831 | B2 | 3/2013 | McInerney | |
| 8,540,122 | B2 | 9/2013 | Skillern | |
| 8,622,262 | B2 | 1/2014 | Van Art | |
| 9,113,699 | B2 * | 8/2015 | Radosta | A45F 3/20 |
| D782,813 | S * | 4/2017 | Butler | D3/202 |
| 2004/0065703 | A1 | 4/2004 | Bellucci | |
| 2004/0256015 | A1 | 12/2004 | Margetson | |
| 2010/0001022 | A1 * | 1/2010 | McInerney | A45F 3/16 222/175 |
| 2010/0116848 | A1 * | 5/2010 | Powers | A45F 3/20 222/146.5 |
| 2010/0258498 | A1 | 10/2010 | Finelli | |
| 2012/0048898 | A1 | 3/2012 | Franklin | |
| 2012/0152986 | A1 * | 6/2012 | Van Art | A45F 3/20 224/148.2 |
| 2013/0056372 | A1 * | 3/2013 | Lynch | B65D 75/5877 206/218 |
| 2013/0075393 | A1 | 3/2013 | Haynie | |

* cited by examiner

PERSONAL HYDRATION DEVICE

FIELD OF THE INVENTION

The present invention relates generally to hydration devices for exercise, sports activities, and military use, and more particularly, relating to a personal hydration device that can be worn about a user's arm or leg.

BACKGROUND OF THE INVENTION

Arm-worn devices for holding water or liquid for drinking are known. The devices include containers made of a hard, non-flexible material or of a flexible material with a bladder-like construction. In their instance, the container is attached or otherwise secured to a user's arm with the intent of the container moving along with the user's arm. These devices further include a straw or tube-like structure that a user can use to drink the water or liquid held within the container.

While existing devices provide convenience of carrying water upon a user's arm, they have drawbacks. Initially, the containers have relatively large profiles and interfere with the arm movement of a user. For example, the containers tend to rub or hit upon a user's body during the back-and-forth arm motion. Additionally, the water or liquid sloshes back-and-forth within the container as a user moves his or her arm. This sloshing causes undesirable muscle strain and fatigue which can result in poor athletic performance or injure the user.

SUMMARY OF THE INVENTION

In view of the foregoing problems with existing hydration devices, embodiments of the present invention provide a new hydration device that is secured to a user's arm or leg and has construction aimed toward overcoming the drawbacks of existing arm worn hydration devices.

In general, in one aspect, a hydration device securable to a user's arm or leg is provided. The hydration device includes a flexible bladder for receiving and holding a liquid. The bladder has a length and a width, wherein when the bladder is secured to a user's arm or leg, the length extends along the arm or leg to which the bladder is secured. The bladder includes a plurality of liquid receiving chambers that extend across the width of the bladder and that are spaced along the length of said bladder. One or more liquid conveying tubes are fluidic communication with the liquid receiving chambers for filling the chambers with liquid and for withdrawing the liquid from the chambers.

In general, in another aspect, the liquid receiving chambers are disposed in an alternating configuration on opposite sides of the bladder in a direction along the length.

In general, in another aspect, the hydration device includes a drinking tube and a bite valve connected to an end of the drinking tube; and a coupling fluidically connected to the one or more liquid conveying tubes for detachably connecting the drinking tube to the one or more liquid conveying tubes.

In general, in another aspect, the coupling has a valve that operates to seal the bladder.

In general, in another aspect, the hydration device includes a wrist strap for securement about a user's wrist, and wherein the drinking tube is secured to the wrist strap.

In general, in yet another aspect, the hydration device includes a sleeve having open opposite ends, and wherein the bladder is secured to the sleeve.

In general, in yet another aspect, the sleeve is disposed along a user's arm or leg.

In general, in yet another aspect, the liquid chambers expand when filled with a liquid and collapse when liquid is withdrawn therefrom.

In general, in yet another aspect, the bladder has a forearm portion and an upper arm portion, and wherein the forearm portion may be cylindrical shaped and define an arm passage.

In general, in yet another aspect, the bladder has a lower leg portion and a thigh portion, and wherein the lower leg portion may be cylindrical shaped and define a leg passage.

In general, in yet another aspect, the hydration device includes a bottle for holding a liquid, and wherein the collapsible bottle is detachably connectable to the one or more fluid conveying tubes and is collapsible to transfer the liquid into the liquid chambers.

There has thus been outlined, rather broadly, the more important features of the invention in order that the detailed description thereof that follows may be better understood and in order that the present contribution to the art may be better appreciated.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

For a better understanding of the invention, its operating advantages, and the specific objects attained by its uses, reference should be had to the accompanying drawings and descriptive matter in which there are illustrated embodiments of the invention.

BRIEF DESCRIPTION OF THE DRAWINGS

The following drawings illustrate by way of example and are included to provide further understanding of the invention for the purpose of illustrative discussion of the embodiments of the invention. No attempt is made to show structural details of the embodiments in more detail than is necessary for a fundamental understanding of the invention, the description taken with the drawings making apparent to those skilled in the art how the several forms of the invention may be embodied in practice. Identical reference numerals do not necessarily indicate an identical structure. Rather, the same reference numeral may be used to indicate a similar feature of a feature with similar functionality. In the drawings.

DETAILED DESCRIPTION OF THE INVENTION

Referring now to FIGS. 1-9 of the drawings, and more particularly to FIGS. 1-4, shown therein and designated by the reference number 10 is a hydration device constructed in accordance with an embodiment of the present invention.

Figure 9:
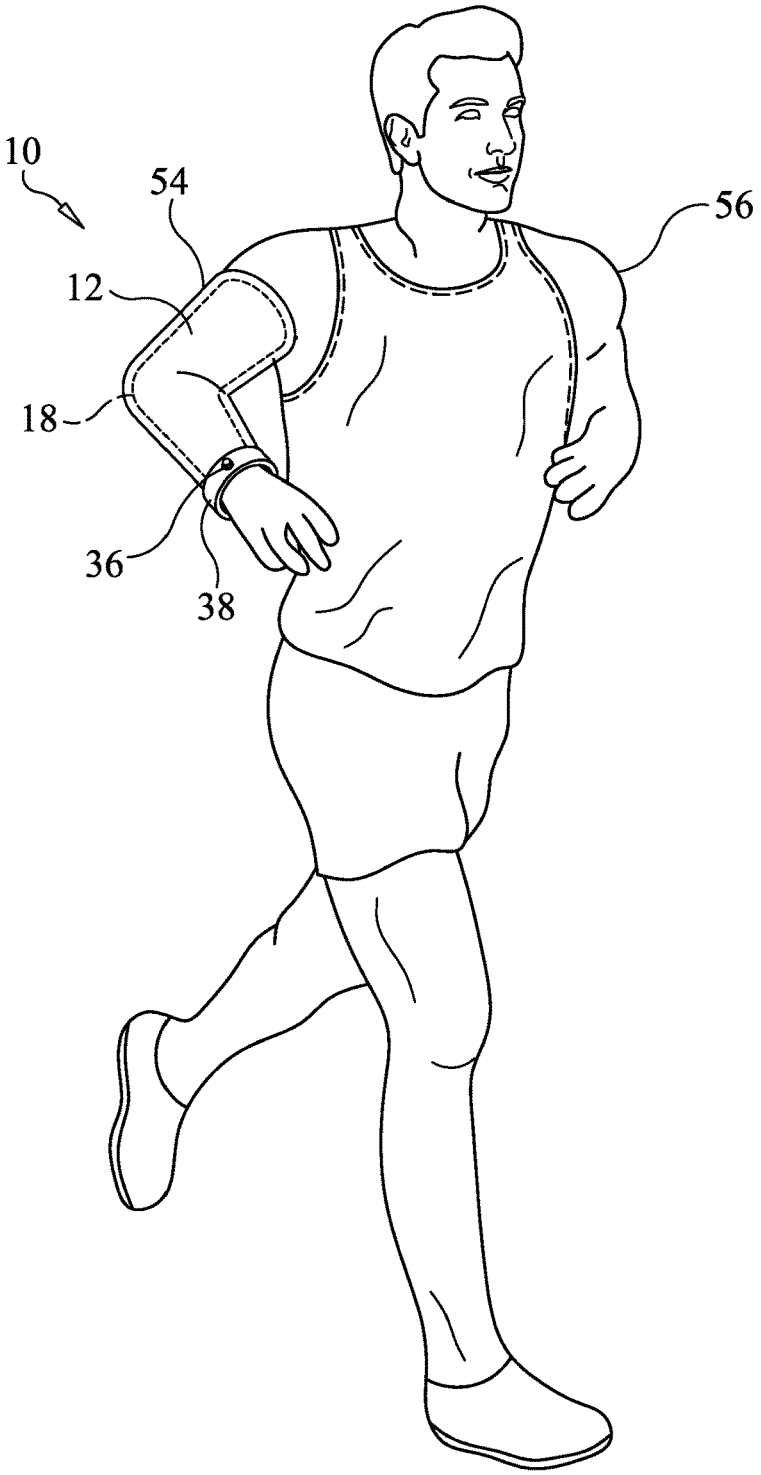
FIG. 9 is a diagrammatic view illustrating the hydration device in use, secured to the arm of a person that is running.

The hydration device 10 includes an arm sleeve 12 that is worn on a user's arm and has open opposite ends 14 and 16 through which the user's arm extends, as best seen in FIG. 9. The arm sleeve 12 is made of a flexible, elastic-like material that is capable of stretching and conforming to the user's arm. In embodiments, the material may also be a wicking material. In embodiments, the arm sleeve 12 may be constructed to have several different layers of material, such as, for example the arm sleeve could be constructed to include inner liner and an exterior layer.

The hydration device 10 further includes a bladder 18 that is attached to the sleeve 12, such as, for example by disposing the bladder within a pocket 13 formed into the sleeve. In embodiments, the bladder 18 may be removably secured within a pocket formed into the arm sleeve 12. In other embodiments, the bladder 18 is permanently attached to the arm sleeve 12 and cannot be separated from the arm sleeve 12.

The bladder 18 has a forearm portion 20 and an upper arm portion 22. In the depicted embodiment, the forearm portion 20 has a generally cylindrical to tapering shape to generally fit the tapering shape of a forearm. Further, in the depicted embodiment, the upper arm portion 22 has a generally semi-circular shape to fit partially around a user's upper arm. In other embodiments, the forearm portion 20 and the upper arm portion 22 may both be cylindrical shaped, or the forearm portion and the upper arm portion may both be semi-circular shaped. The bladder 18 is made of a pliable material and, as discussed in further detail below, expands when filled with a liquid and contracts when liquid is removed.

As further depicted, the bladder 18 includes a plurality of liquid receiving chambers 24 for receiving and holding a liquid. The chambers 24 are formed such that each of the chambers extends laterally across the width of the bladder 18 and are spaced along the length of the bladder 18. The chambers 24 being formed such that they extend laterally across the width of bladder 18 performs a critical function of the hydration device 10 by preventing liquid held by the bladder 18 from sloshing back-and-forth between opposite ends of the bladder 18. More specifically, the chambers 24 are configured in a manner such that liquid is unlikely to flow between the chambers 24 when the bladder 18 is moved back-and-forth, for example when a user is running, thereby reducing transient forces being applied to a user's arm caused by moving liquid. This reduction of transient forces reduces muscle strain and fatigue that devices heretofore do not address.

Figure 1:
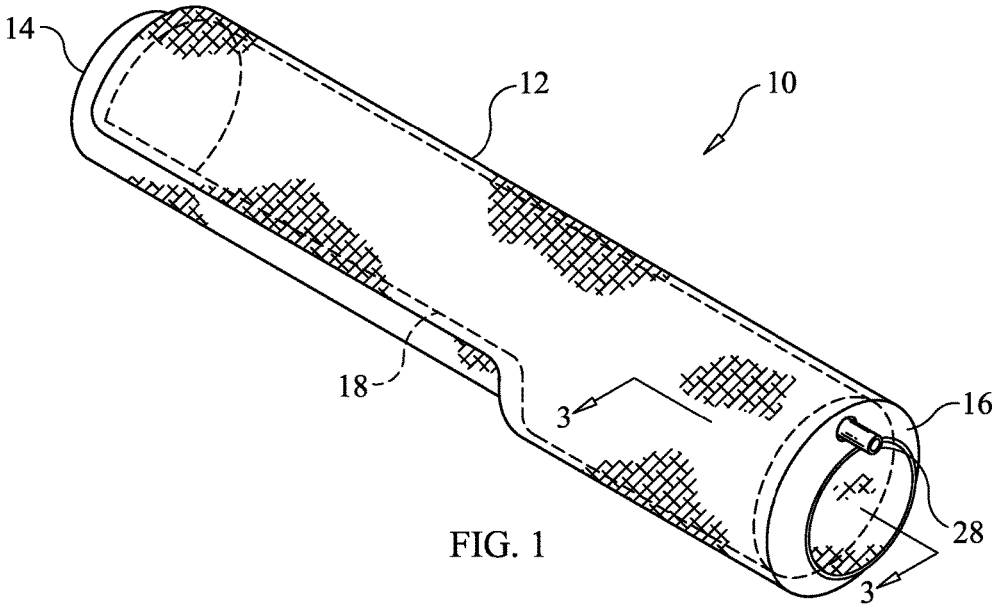
FIG. 1 is a perspective view of a hydration device that is constructed in accordance with the principles of an embodiment of the present invention.
Figure 2:
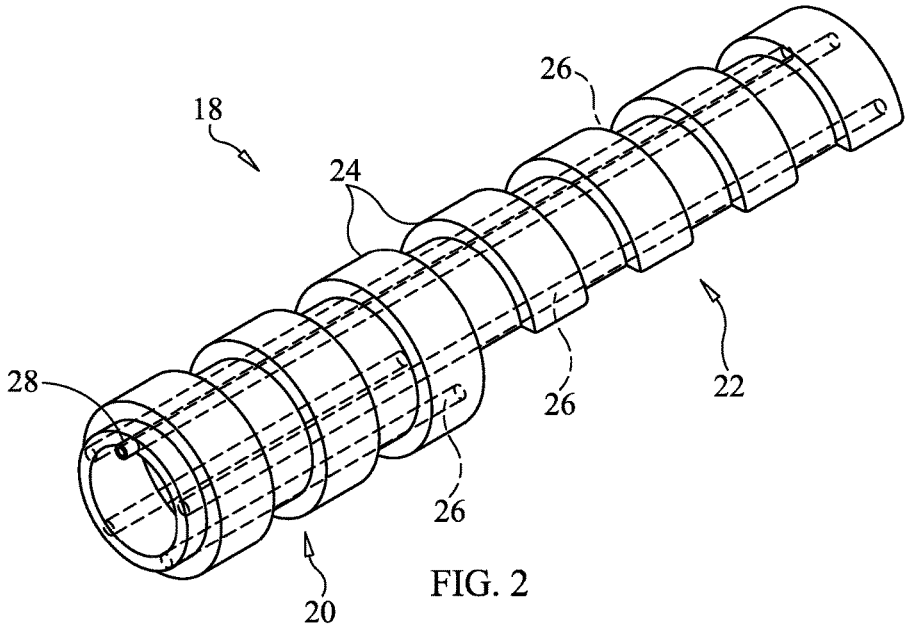
FIG. 2 is a perspective view of a bladder of a hydration device that is constructed in accordance with the principles of an embodiment of the present invention.
Figure 3:
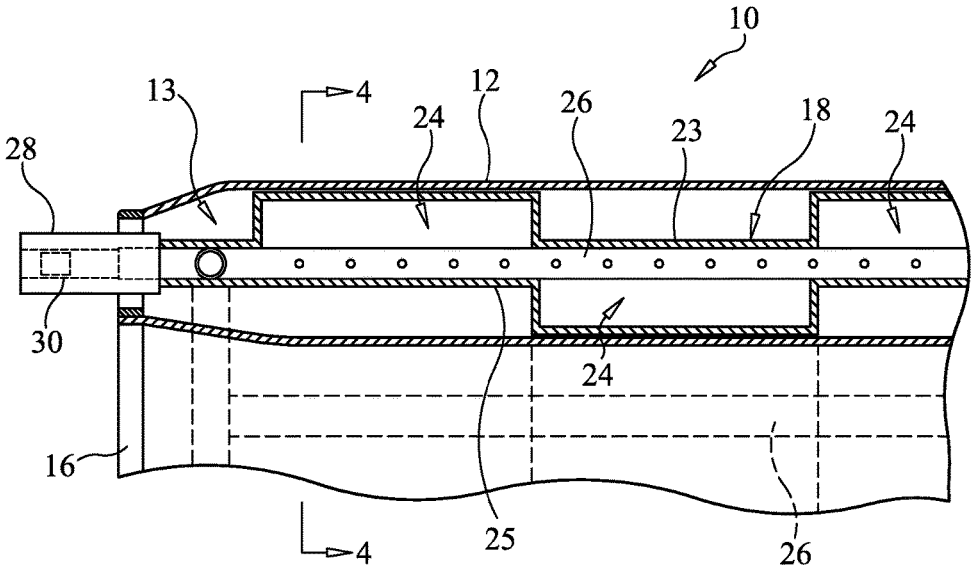
FIG. 3 is a partial cross-sectional view of the hydration device taken along the line 3-3 in FIG. 1.
Figure 4:
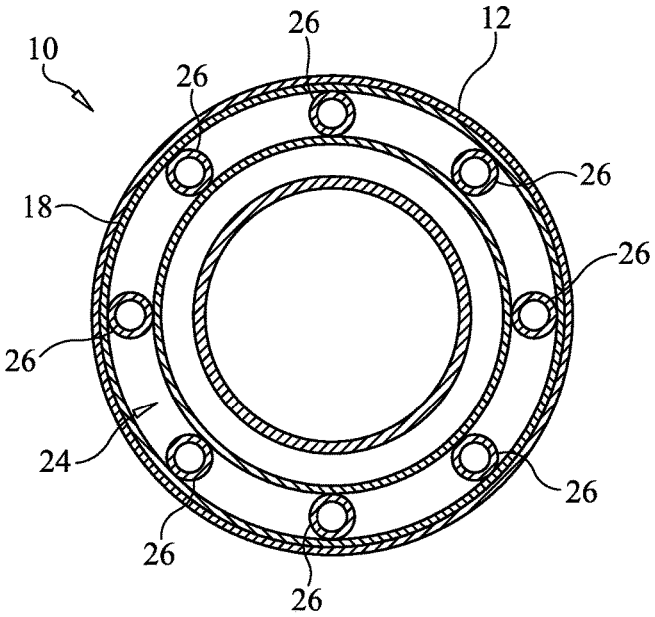
FIG. 4 is a cross-sectional view of the hydration device taken along line 4-4 in FIG. 3.

Further, in the depicted embodiment, the chambers 24 are formed such that the chambers 24 are disposed in an alternating configuration on opposite sides 23 and 25 of the bladder 18 in a direction along the length. The alternating configuration is such that bladders 24 alternate from being disposed on the first side 23 and the second side 25 of the bladder 18 along the bladder's length, as best seen in FIG. 3. This construction better distributes the weight of the liquid evenly across a user's arm, further reducing muscle strain and fatigue. This construction also has the benefit of allowing the bladder 18 to have a thinner profile, thereby preventing the hydration device from interfering with body movements. For example, the thin profile reduces the tendency of the bladder 18 from contacting a user's body as the arm is moved back-and-forth.

The hydration device 10 further includes at least one fluid conveying tube 26 positioned within the bladder 18 and extending along its length. In the depicted embodiment, a plurality of fluid conveying tubes 26 are provided that extend along the length of the bladder 18 and are spaced along the width of the bladder 18 (spaced circumferentially around the forearm portion 20). Each tube 26 is in fluidic communication with at least one fluid chamber 24 through which it extends, by perforations formed into the tube, for example. Alternatively, the one or more fluid conveying tubes 26 could extend along the exterior of the bladder 18 and be connected to the bladder 18 in manner such each tube is fluidically connected to at least one fluid chamber 24.

The one or more fluid conveying tubes 26 are fluidically connected to a coupling 28. The coupling 28 is provided for attaching and detaching a drinking tube or hose to the fluid conveying tubes 26 for a user to draw refreshment from the bladder 18. In addition, the coupling 28 is provided for attaching and detaching a liquid refill container to the tubes 26 so that the bladder 18 can be filled with liquid. Importantly, the coupling 28 includes a shutoff valve 30 that operates to seal the one or more tubes 26, and ultimately the bladder 18, when the drinking tube or refill container is detached from the coupling. An example of a suitable coupling is described in U.S. Pat. No. 7,311,231, the entirety of which is incorporated herein by reference.

As explained above, the bladder 18 is made of a pliable material that permits the bladder 18 to expand when filled with liquid and to collapse when liquid is drawn from the bladder 18. More specifically, each chamber 24 expands when filled with liquid and then collapses when the liquid is removed, which prevents the user's intake of air.

Figure 5:
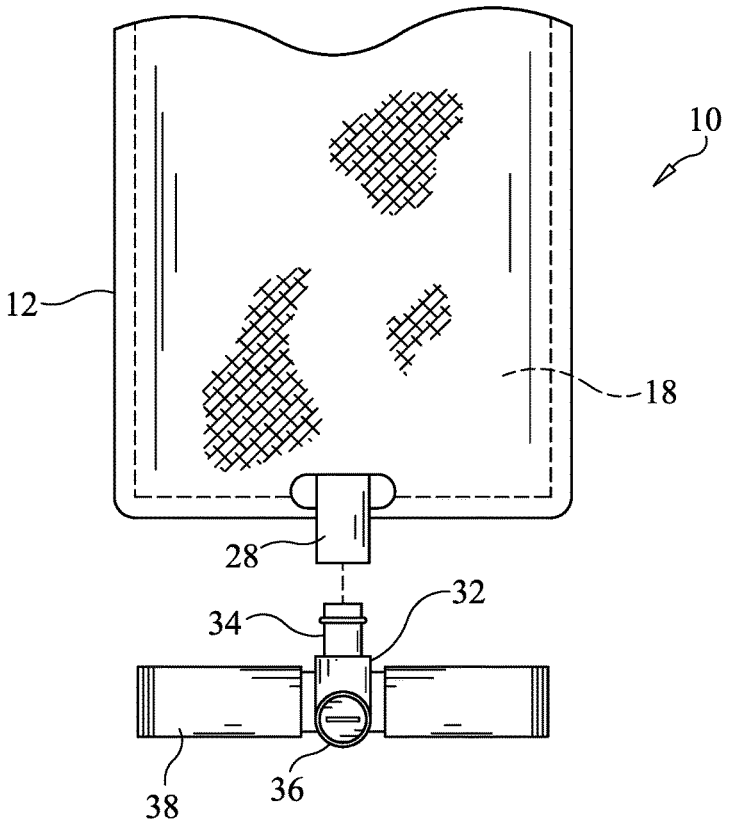
FIG. 5 is diagrammatic view illustrating a drinking tube of the hydration device being connected to the bladder.
Figure 6:
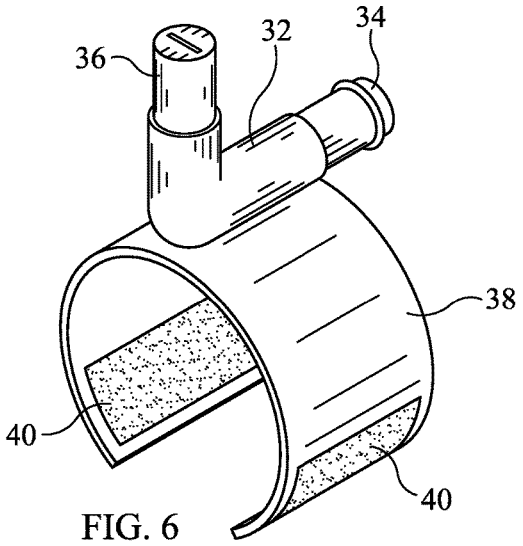
FIG. 6 is a perspective view of a drinking tube connected to a wrist strap.

With reference to FIGS. 5 and 6, the hydration device 10 includes a drinking tube 32 having a nib 34 at one end and a bite valve 36 at the opposite end. The drinking tube 32 is connected to the bladder 18 by inserting nib 34 into coupling 28, which activates valve 30 and fluidically connects the bladder 18 and drinking tube 32 together. The drinking tube 32 is secured to the coupling by friction or a bayonet coupling (not shown), for example.

In the depicted embodiment, the drinking tube 32 is relatively short and is secured to a wrist strap 38 that is worn about a user's wrist to secure the drinking tube the user's wrist. In this manner, drinking of liquid from the bladder 18 is accomplished by raising the wrist to the user's mouth where the user may place the bite valve between his or her teeth.

As shown, the wrist strap 38 is secured about a user's wrist by a cooperating fastener 40, such as, for example a touch fastener. Alternatively, the wrist strap 38 could be continuous band and made of an elastic material allowing the strap to slip over a user's hand and onto the wrist. In further alternative embodiments (not shown), the drinking tube 32 could be of a greater length, permitting the bite valve end of the tube to be secured closer to a user's mouth, by a headband, for example.

Figure 7:
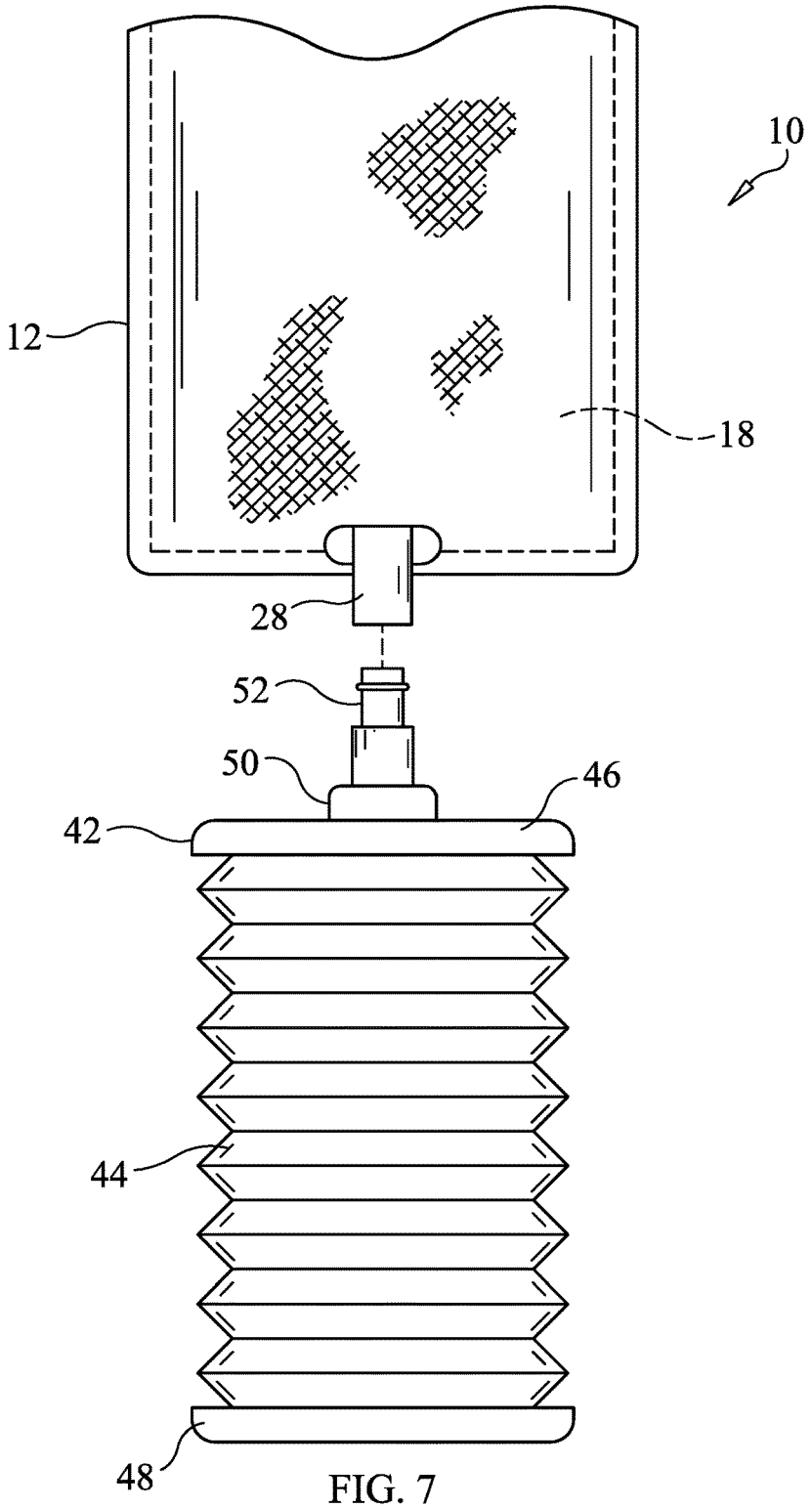
FIG. 7 is a is diagrammatic view illustrating a refill bottle of the hydration device being connected to the bladder.
Figure 8:
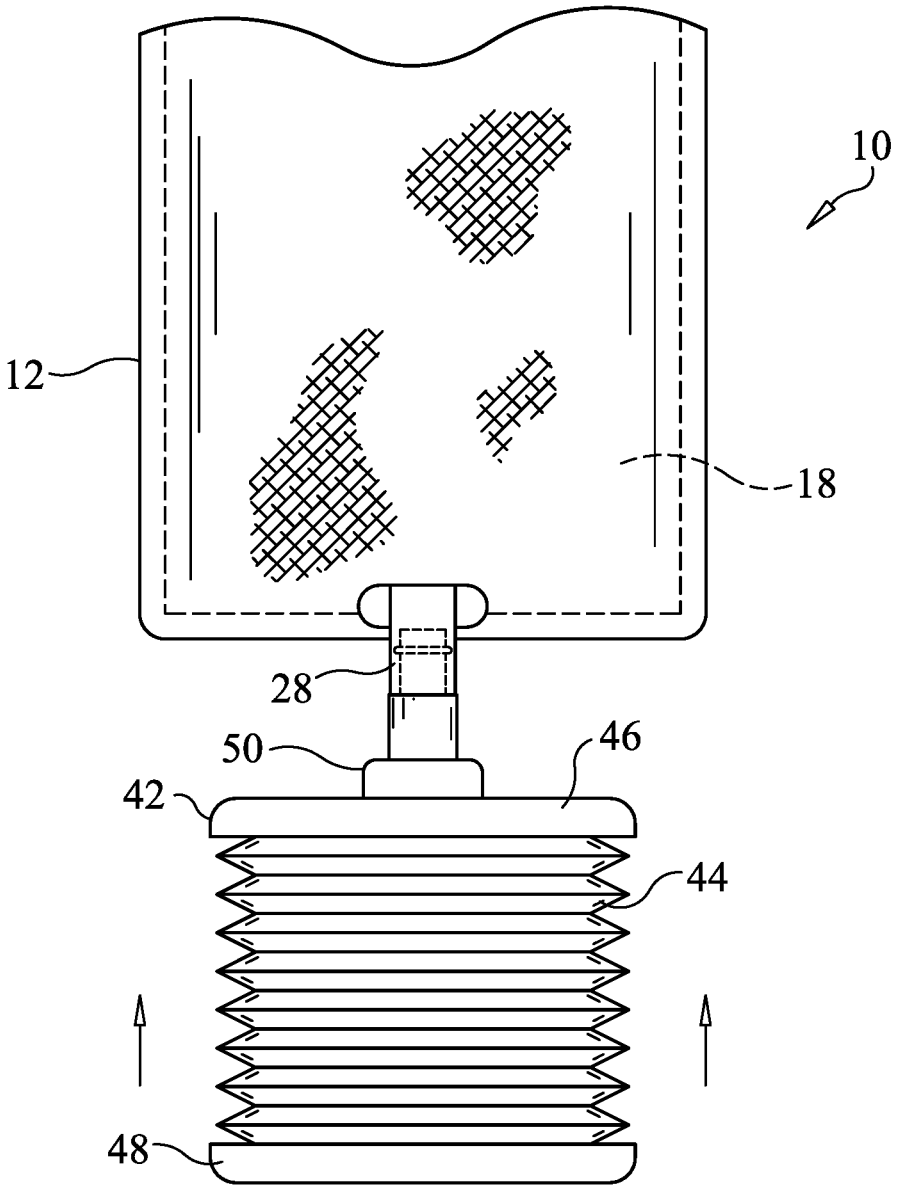
FIG. 8 is a diagrammatic view illustrating the refill bottle connected to the bladder and being collapsed to transfer fluid from the bottle into the bladder.

With reference to FIGS. 7 and 8, a liquid refill bottle 42 may be provided for filling the bladder 18 with liquid. In the representatively illustrated embodiment, bottle 42 includes a collapsible body portion 44 that is fitted on opposite ends with end caps 46 and 48. A cap 50 may be removably connected to end cap 46 to permit refilling the bottle with a desired liquid. A nib 52 extends from cap 50 and is fluidically connected to the interior of the bottle 42. The bottle 42 is removably connected to the bladder 48 by inserting nib 52 into coupling 28, which activates valve 30 and fluidically connects the bladder and bottle together. The bottle 42 is secured to the coupling by friction or a bayonet coupling (not shown), for example.

Once the bottle 42 is connected to the bladder 18 via coupling 28, the bottle is collapsed so as to transfer the liquid contained by the bottle into the liquid chambers 24 of the bladder 18. After the liquid has been transferred, the bottle 42 is disconnected from the bladder 18 by removing nib 52 from coupling 28, which activates valve 30, sealing the bladder.

Turning now to FIG. 9, there is shown the hydration device 10 in use and secured about the arm 54 of a user 56 who is running. The bladder 18 is secured to the arm 54 with the length of the bladder 18 extending along the length of the arm 54, which positions the fluid chambers 24 across the arm 54. The user 56, desiring a drink, simply raises his wrist toward his mouth so that the bite valve 36 can be placed into the mouth and operated. This action can be performed without stopping from running.

Figure 10:
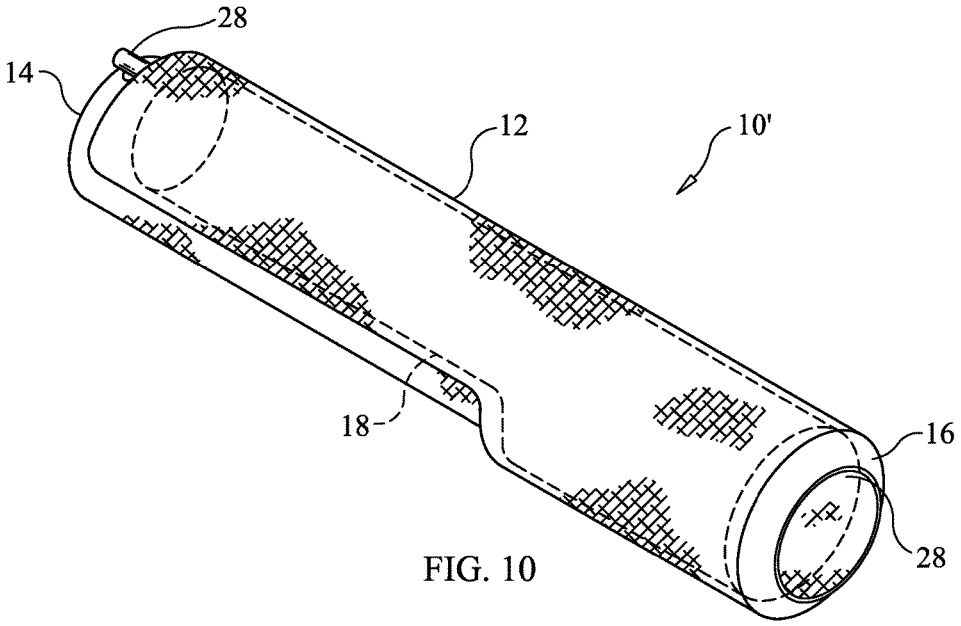
FIG. 10 is a perspective view of a hydration device that is constructed in accordance with the principles of an alternative embodiment of the present invention.
Figure 11:
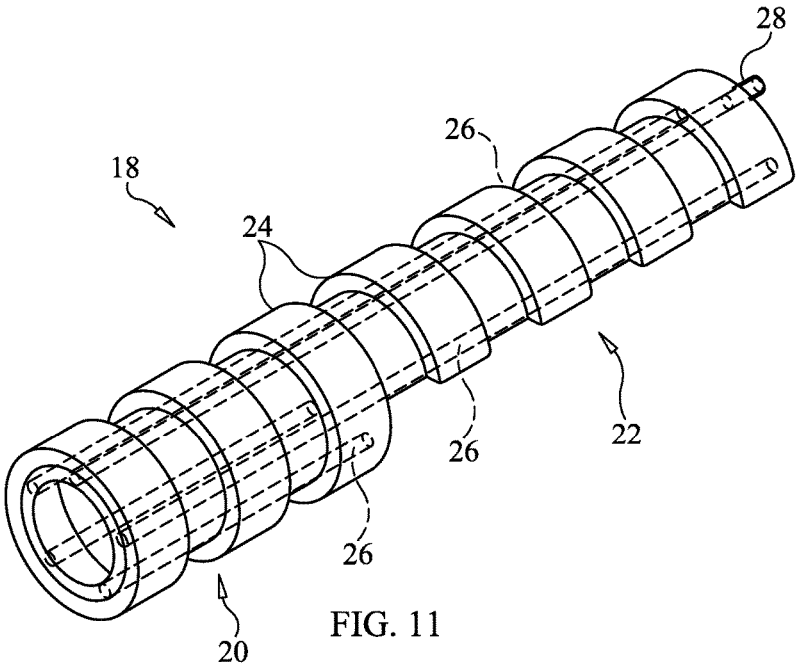
FIG. 11 is a perspective view of a bladder of a hydration device that is constructed in accordance with the principles of an alternative embodiment of the present invention.
Figure 12:
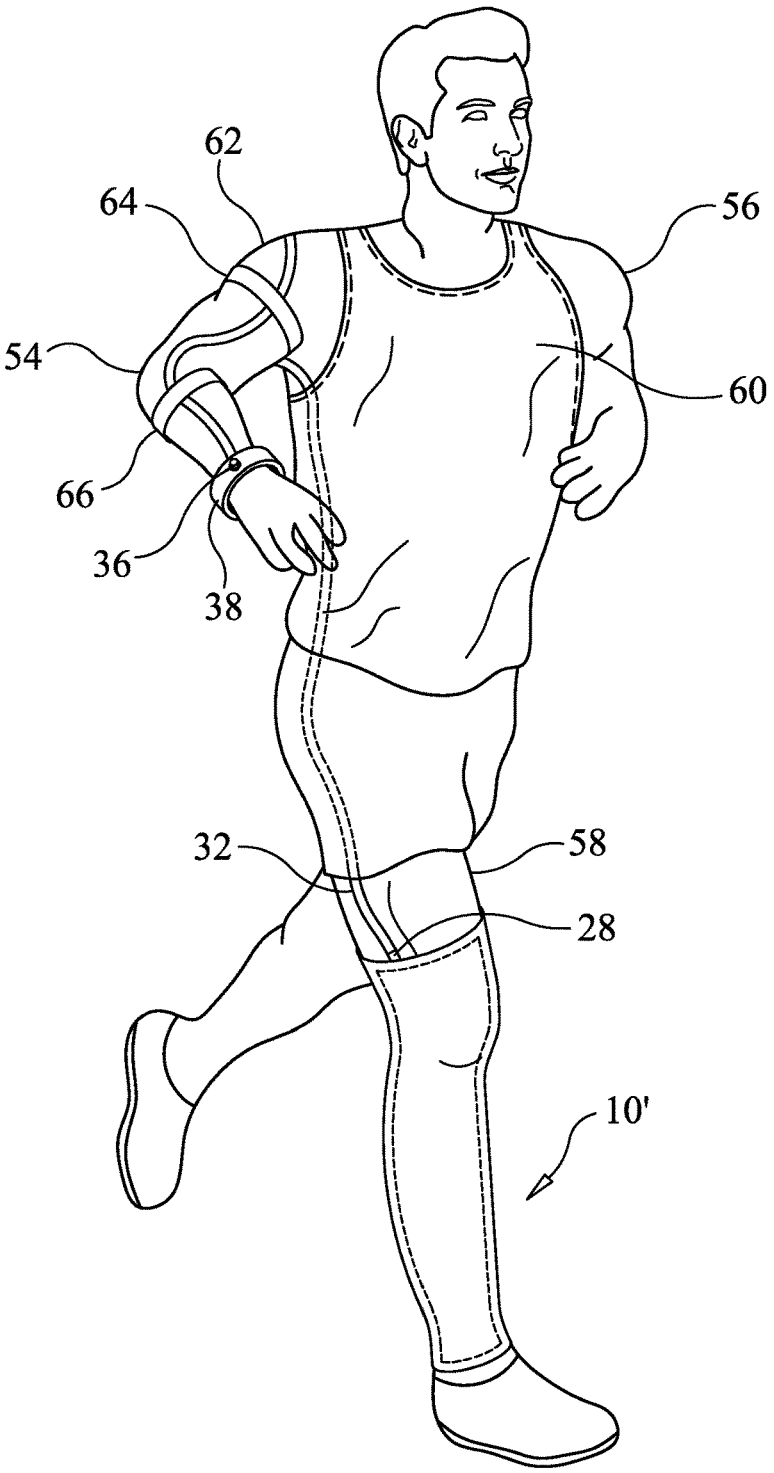
FIG. 12 is a diagrammatic view illustrating the hydration device in use, secured to the leg of a person that is running.

With reference to FIGS. 10-12, an alternative embodiment of the present invention, hydration device 10*a* is illustrated. The hydration device 10*a* includes a leg sleeve 58 that is worn on a user's leg. Leg sleeve 58 is constructed in similar fashion to the arm sleeve 12, described above, however the shape is configured to be worn on a user's leg, as best seen in FIG. 10.

The hydration device 10*a* further includes a bladder 18*a* that is attached to the leg sleeve 58, such as, for example by disposing the bladder 18*a* within a pocket formed into the leg sleeve 58. As described above in alternative embodiments, the bladder 18*a* may be removably secured within a pocket formed in the leg sleeve 58. In further embodiments, the bladder 18*a* is permanently attached to the leg sleeve 58 and cannot be separated from the leg sleeve 58.

The bladder 18*a* has a lower leg portion 60 and a thigh portion 62. In the embodiment illustrated in FIG. 10, the lower leg portion 60 has a generally cylindrical shape that tapers at end 64 to fit a user's ankle 66. The thigh portion 62 has a generally semi-circular shape to fit partially around a user's thigh.

The bladder 18*a* further includes a plurality of liquid receiving chambers 68 and one or more fluid conveying tubes 70. The chambers 68 and fluid conveying tubes that are configured to be like that of the chambers 24 and fluid conveying tubes 26, described above with reference to the embodiment illustrated in FIGS. 1-9. Bladder 18*a* is secured to the leg 74 with the length of the bladder 18*a* extending along the length of the leg 74, which positions the fluid chambers 68 across the leg 74.

Device 10*a* further includes the coupling 28 as described in the previous embodiment, above. Coupling 28 is provided for attaching and detaching an elongated flexible tube or hose 72 to the fluid conveying tubes 70 for a user to draw refreshment from the bladder 18*a*.

In the depicted embodiment, the elongated flexible tube 72 extends from a user's leg 74, along the body 71 of the user, to the user's shoulder area 76. The elongated flexible tube 72 may extend between the user's body 71 and their clothes 82 to secure the elongated flexible tube 72 to the user. The elongated flexible tube 72 continues from the user's shoulder 76, down the user's arm 74, and is secured to the user's arm 74 by arm straps 78 and 80 that extend about the user's arm 74. The elongated flexible tube 72 fluidically connects the bladder 18*a* to the wrist strap 38, to facilitate transfer of liquid from bladder 18*a* to the user.

A number of embodiments of the present invention have been described. Nevertheless, it will be understood that various modifications may be made without departing from the spirit and scope of the invention and the following claims.

What is claimed is:

1. A personal hydration device securable to an arm or leg of a user, the device comprising:

a flexible bladder for receiving and holding a liquid, said flexible bladder having a length and a width, wherein when said flexible bladder is secured to a user's arm or leg, said length of said flexible bladder extends along a length of the arm or leg to which the flexible bladder is secured;

said flexible bladder having a plurality of elongated liquid receiving chambers, each having a length greater than its width, wherein said length of each of said liquid receiving chambers extends across said width of said flexible bladder such that when said flexible bladder is secured to a user's arm or leg said length of each of said liquid receiving chambers is positioned across the user's arm and at least partially encircles the arm or leg to which said flexible bladder is secured;

one or more liquid conveying tubes in fluidic communication with said plurality of liquid receiving chambers;

wherein said bladder has an exterior first side, an interior second side opposite of said first side, and a thickness between said first and said second sides, wherein when said bladder is secured to the user's arm or leg, said first side is disposed outwardly from said second side relative to the user's arm or leg; and wherein said plurality of liquid receiving chambers alternate in series one after another along said length of said bladder from being disposed on said first side and said second side of said bladder along said length of said bladder.

2. The device of claim 1, further comprising:

a drinking tube;

a bite valve connected to an end of said drinking tube; and a coupling fluidically connected to said one or more liquid conveying tubes for detachably connecting said drinking tube to said one or more liquid conveying tubes to draw liquid from said plurality of liquid receiving chambers through said bite valve.

3. The device of claim 2, further comprising:

a wrist strap for securement about a user's wrist, wherein said drinking tube is secured to said wrist strap.

4. The device of claim 2, wherein said coupling includes a valve that fluidically seals said coupling from said one or more liquid conduits.

5. The device of claim 1, further comprising:

a sleeve having open opposite ends, wherein said flexible bladder is secured to said sleeve.

6. The device of claim 1, wherein said plurality of liquid chambers expand when filled with a liquid and collapse when liquid is withdrawn therefrom.

7. The device of claim 1, wherein said flexible bladder has a forearm portion and an upper arm portion, said forearm portion being cylindrically shaped and defining an arm passage; and wherein said forearm portion and said upper arm portion each have one or more liquid chambers of said plurality of liquid chambers.

8. The device of claim 1, wherein said flexible bladder has a lower leg portion and a thigh portion, said lower leg portion being cylindrically shaped and defining a leg passage; and wherein said lower leg portion and said thigh portion each have one or more liquid chambers of said plurality of liquid chambers.

9. The device of claim 1, further comprising:

a collapsible bottle for holding a liquid, wherein said collapsible bottle is detachably connectable to one or more of said fluid conveying conduits and is collapsible to transfer the liquid into said flexible bladder.

10. A personal hydration device securable to an arm or leg of a user, the device comprising:

a flexible bladder for receiving and holding a liquid, said flexible bladder having a length and a width, wherein when said flexible bladder is secured to a user's arm or leg, and said length of said flexible bladder extends along a length of the arm or leg to which the flexible bladder is secured;

said flexible bladder having a plurality of elongated liquid receiving chambers, each having a length greater than its width, wherein said length of each of said liquid receiving chambers extends across said width of said flexible bladder such that when said flexible bladder is secured to a user's arm or leg said length of each of said liquid receiving chambers is positioned across the user's arm and at least partially encircles the arm or leg to which said flexible bladder is secured;

one or more liquid conveying tubes in fluidic communication with said plurality of liquid receiving chambers;

a coupling fluidically connected to said one or more liquid conveying tubes, said coupling including a valve that operates to fluidically seal said coupling from said one or more liquid conveying tubes;

a drinking tube having a first end that is detachably connectable to said coupling to establish a fluidic connection between said drinking tube and said one or more liquid conveying tubes;

a bite valve connected to a second end of said drinking tube;

wherein said flexible bladder has an exterior first side, an interior second side opposite of said first side, and a thickness between said first and said second sides, wherein when said flexible bladder is secured to the user's arm or leg, said first side is disposed outwardly from said second side relative to the user's arm or leg; and wherein said plurality of liquid receiving chambers alternate in series one after another along said length of said bladder from being disposed on said first side and said second side of said bladder along said length of said bladder.

11. The device of claim 10, further comprising:

a wrist strap for securement about a user's wrist, wherein said drinking tube is secured to said wrist strap.

12. The device of claim 10, further comprising:

a sleeve having open opposite ends, wherein said flexible bladder is secured to said sleeve.

13. The device of claim 10, wherein said flexible bladder has a forearm portion and an upper arm portion, said forearm portion being cylindrically shaped and defining an arm passage; and wherein said forearm portion and said upper arm portion each have one or more liquid chambers of said plurality of liquid chambers.

14. The device of claim 10, wherein said flexible bladder has a lower leg portion and a thigh portion, said lower leg portion being cylindrically shaped and defining a leg passage; and wherein said lower leg portion and said thigh portion each have one or more liquid chambers of said plurality of liquid cha.

15. The device of claim 10, further comprising:

a collapsible bottle for holding a liquid, wherein said bottle is detachably connectable to said coupling and is collapsible to transfer liquid from said bottle into said flexible bladder.

16. The device of claim 1, wherein at least two liquid receiving chambers of said plurality of liquid receiving chambers alternate on opposite sides of at least one of said one or more liquid conveying tubes.

17. The device of claim 10, wherein at least two liquid receiving chambers of said plurality of liquid receiving chambers alternate on opposite sides of at least one of said one or more liquid conveying tubes.

* * * * *